US005647089A

United States Patent [19]

Hollrock

[11] Patent Number: 5,647,089

[45] Date of Patent: Jul. 15, 1997

[54] APPARATUS FOR WASHING AND SORTING PLASTIC BALLS

[75] Inventor: J. Richard Hollrock, South Deerfield, Mass.

[73] Assignee: Hollrock Engineering, Inc., Hadley, Mass.

[21] Appl. No.: 489,079

[22] Filed: Jun. 9, 1995

[51] Int. Cl.[6] ..... A47L 5/38

[52] U.S. Cl. ..... 15/302; 15/21.2; 15/308

[58] Field of Search ..... 15/3.11, 21.2, 15/302, 305, 308; 209/600, 601, 660, 662

[56] References Cited

U.S. PATENT DOCUMENTS

| | | | |
|---|---|---|---|
| 2,982,548 | 5/1961 | Kracht et al. | 209/601 |
| 3,038,186 | 6/1962 | Davy | 15/21.2 |
| 3,661,257 | 5/1972 | Hall et al. | 209/662 |
| 4,181,996 | 1/1980 | Hollrock | 15/21.2 |
| 5,077,854 | 1/1992 | Moons | 15/3.11 |
| 5,228,168 | 7/1993 | Hollrock et al. | 15/302 |
| 5,361,440 | 11/1994 | Buchbinder et al. | 15/21.2 |
| 5,373,597 | 12/1994 | Worsham | 15/21.2 |
| 5,551,118 | 9/1996 | Yeh | 15/21.2 |

FOREIGN PATENT DOCUMENTS

| | | | |
|---|---|---|---|
| 220973 | 6/1968 | Sweden | 15/305 |

*Primary Examiner*—David Scherbel
*Assistant Examiner*—Terrence Till
*Attorney, Agent, or Firm*—McCormick, Paulding & Huber

[57] ABSTRACT

Plastic balls of the type used in recreational trampoline type pits are picked up by a hand held conduit and conveyed pneumatically to a sorting station where out of round balls are culled from the stream of balls to be washed. A golf ball type washer cleans and disinfects the balls, which are then conveyed to a storage bag for reuse in the pit.

17 Claims, 3 Drawing Sheets

APPARATUS FOR WASHING AND SORTING PLASTIC BALLS

BACKGROUND OF THE INVENTION

1. Field of the Invention

The present invention relates to apparatus for washing balls, particularly lightweight hollow plastic balls of the type commonly used in recreation areas in conjunction with a trampoline defined pit designed to hold a large quantity of such balls, and to provide a soft structure play unit. The balls are designed to provide a degree of support for children playing in the pit in that they provide a degree of buoyancy and afford a soft environment for play.

2. Description of the Prior Art

Apparatus for washing balls are known, particularly apparatus for washing golf balls. See for example the prior art U.S. Pat. No. 4,181,996. Typically, such a ball washer includes a hopper provided above a tank, and inside the tank a rotating brush is provided for driving the golf balls around a generally helical path, from an inlet associated with the hopper to an outlet where the washed balls are ejected, generally for movement by gravity down an inclined chute into a storage area.

Prior art apparatus designed to sort and wash relatively lightweight hollow plastic balls of the type designed for use in a recreational concave trampoline type pit have not been available. Moreover, due to the use of these hollow plastic balls in recreational trampoline type pits, and the fact that such recreational facilities are frequented by children, there is a need for providing a system to periodically clean such balls.

SUMMARY OF THE INVENTION

It is a general purpose and object of the present invention to provide a system for efficiently cleaning hollow plastic balls of the type used in recreational trampoline type pits, and to also provide for the elimination of defective, or non-round balls, which could prove hazardous to the intended use for the balls in a recreational pit of this type.

This object is accomplished with the present invention by providing a ball washing and sorting system capable of both washing hollow plastic balls and sorting these balls to eliminate defective non-round balls prior to returning them to the pit. The invention also provides for convenient withdrawal of the balls from the pit so as to facilitate their efficient cleaning and sorting. The system also allows for the efficient storing of the balls to facilitate cleaning of the trampoline type pit when emptied of these plastic balls.

The system of the present invention preferably includes a sorting station and a ball washing station. Pneumatic means is provided for transporting the balls from the pit to an inlet of the sorting station where non-round balls are rejected and round balls, or balls not defective enough to require rejection, are moved to an outlet of the sorting station. The balls are gravity fed from the outlet of the sorting station to an inlet of the ball washing station. The ball washing station includes a rotating cylindrically shaped brush, provided in a tank that is filled with fluid so that the balls can be forced around a helical path defined by the tank as a result of rotating the brush. Means is provided for transporting the washed balls from an outlet of the washing station preferably to a ball storage means in the form of an open mesh net that will conveniently store a plurality of the balls until the pit has been prepared for return of the clean balls.

BRIEF DESCRIPTION OF THE DRAWINGS

A more complete understanding of the invention and many of the attendant advantages thereto will be readily appreciated as the same become better understood by reference to the following detailed description when considered in conjunction with the accompanying drawings wherein.

DESCRIPTION OF THE PREFERRED EMBODIMENT

Figure 1:
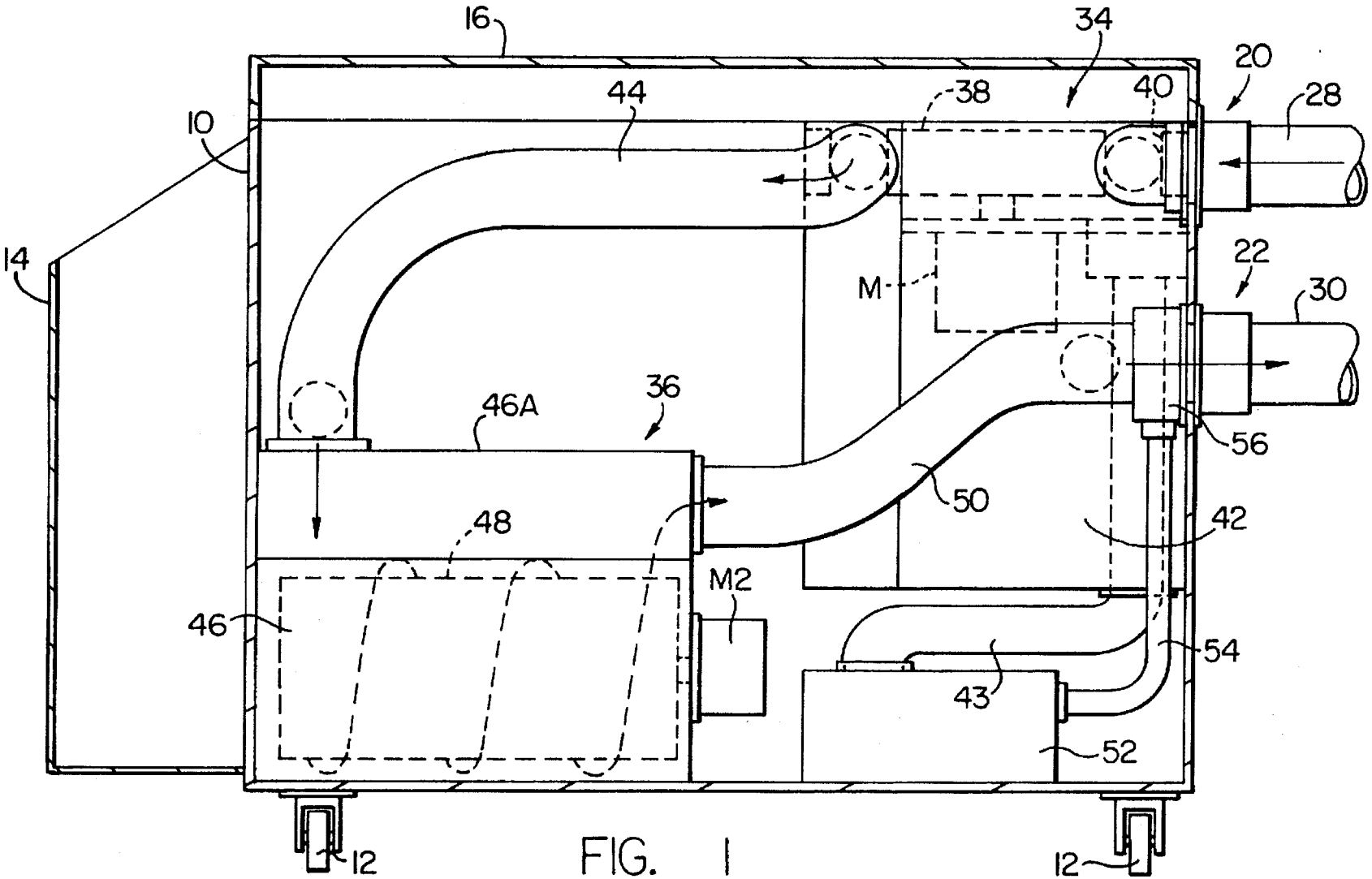
FIG. 1 is a schematic view illustrating the various components of a ball washing and sorting system constructed in accordance with the present invention but with the front wall eliminated to show the interior arrangement of various components.
Figure 2:
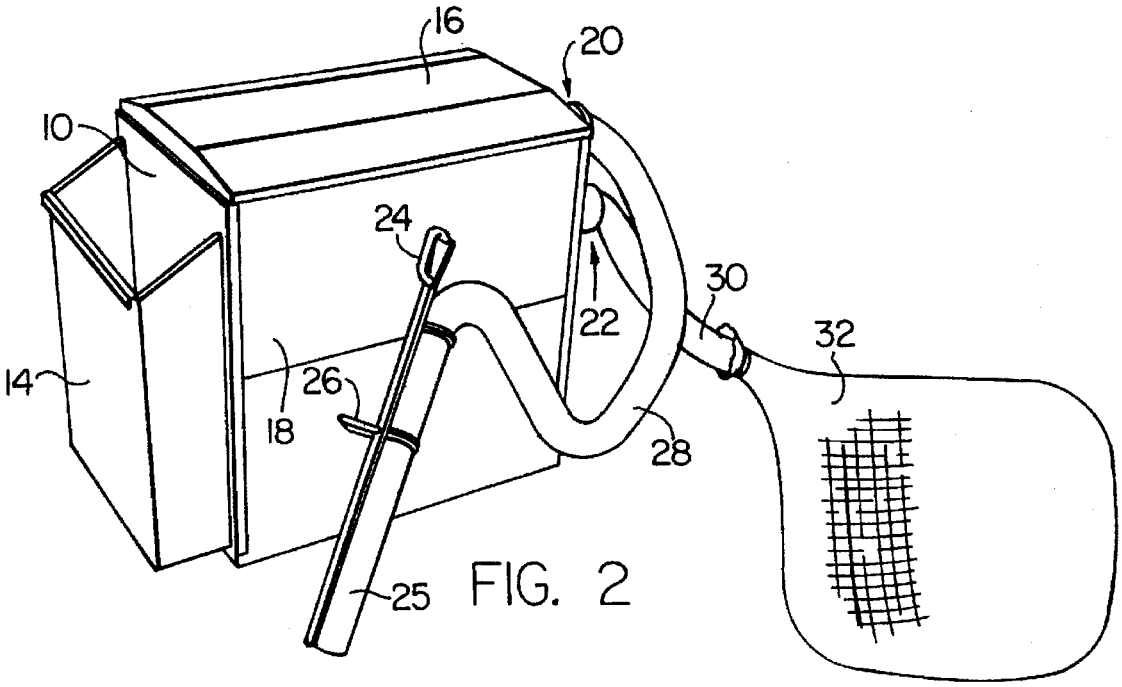
FIG. 2 is a perspective view of a preferred embodiment illustrating the ball pick-up device.
Figure 3:
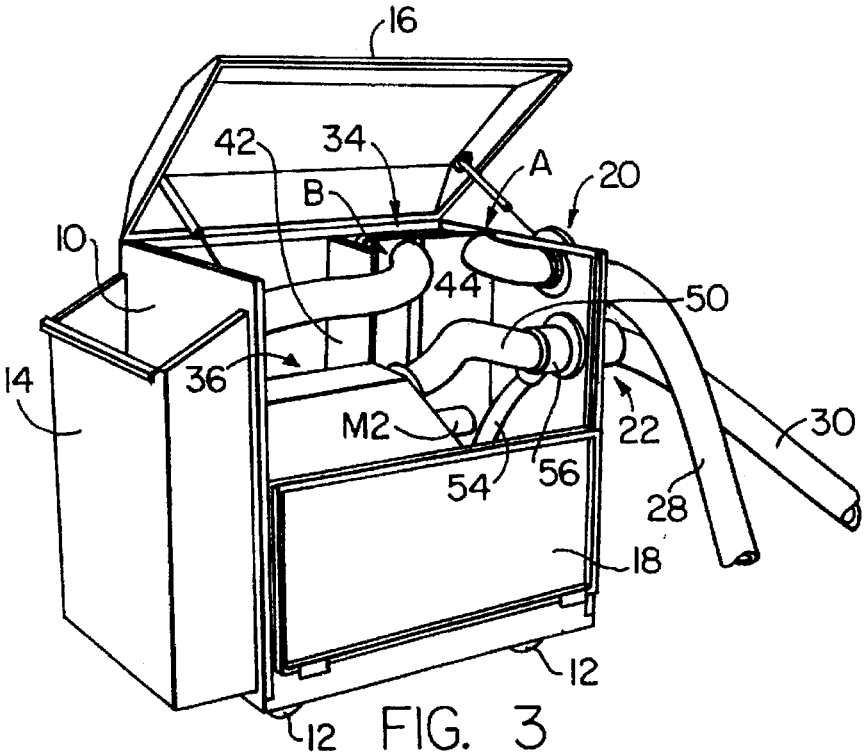
FIG. 3 is a perspective view of the FIG. 1 apparatus opened up to reveal the interior components of the system.

Referring now to FIG. 1, an apparatus of the present invention preferably includes an enclosure 10 of generally rectangular configuration provided on wheels 12 for convenient manipulation into a desired position for use. As best shown in FIG. 2, a storage bin 14 may be provided on one side of the enclosure 10 for storing the conduits 28 and 30 when not in use. As shown in FIG. 2, the enclosure 10 has a hinged lid 16 provided on the top to permit access to the interior of the enclosure 10. Further, a hinged door 18 is preferably provided on the front wall to further facilitate access to the interior. Finally, the enclosure 10 includes a ball inlet port 20 for conduit 28, and has a ball exit port 22 for conduit 30.

As best shown in FIG. 2 a wand 25, having handles 24 and 26, provides a convenient means for manipulating the free end portion of the ball inlet conduit 28 so that the conduit 28 can be used to suck the lightweight plastic balls from the pit (not shown) into the inlet port 20. A similarly configured flexible conduit 30 is connected to exit port 22 of the enclosure 10, and serves to convey the clean balls to a storage area indicated schematically at 32 in FIG. 2. The storage area 32 preferably comprises an open mesh bag with openings of such size as to prevent the spherical balls from passing through these openings, but which is lightweight enough to permit the balls in the mesh bag to be readily transported from one place to another. Such a storage capability for the balls facilitates cleaning of the pit itself prior to return of the clean balls to the pit.

Figure 4:
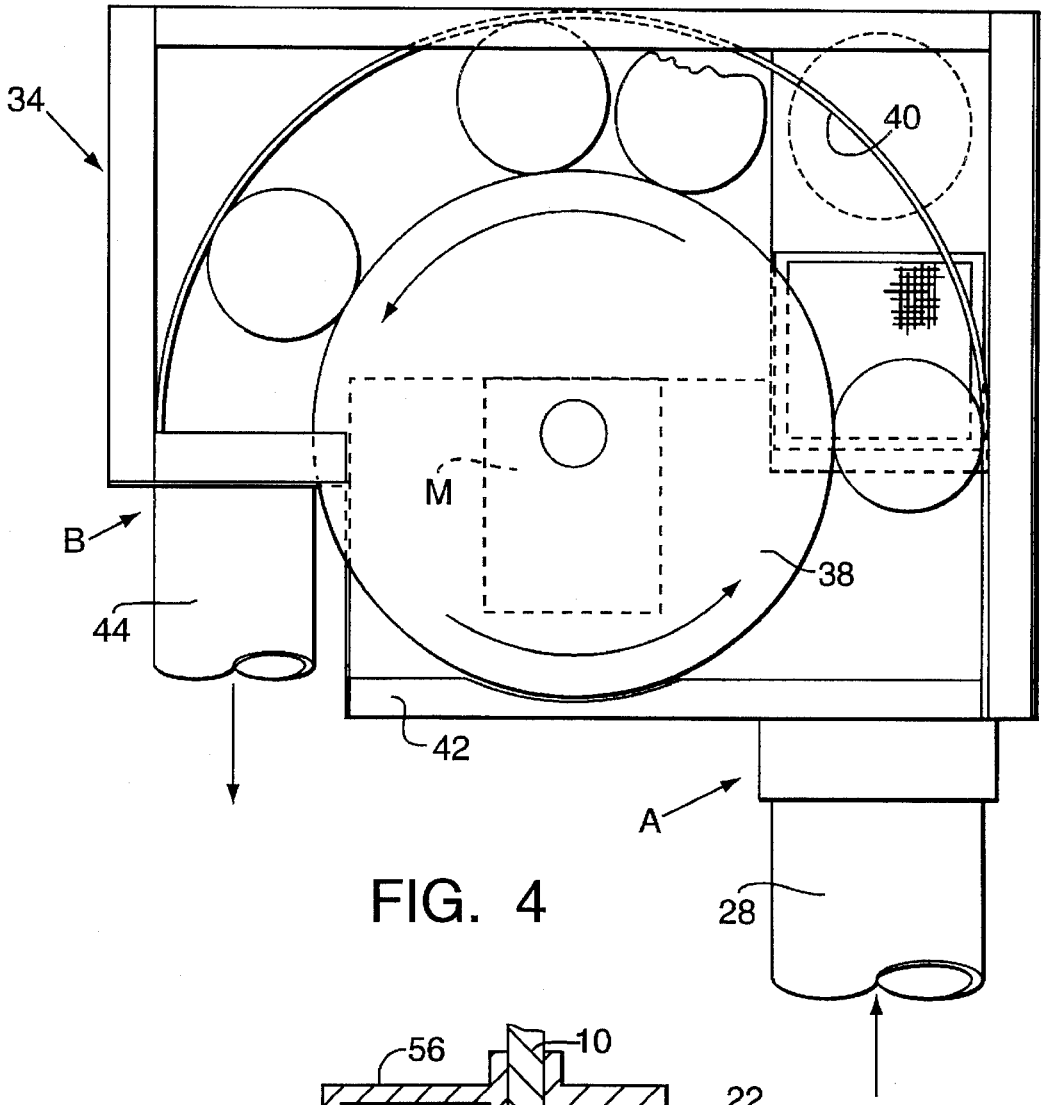
FIG. 4 is a plan view showing schematically the sorting station of FIG. 1.

In accordance with the present invention, a ball sorting station indicated generally at 34 in FIG. 1 is provided adjacent to the inlet 20 for the balls. The ball sorting station 34 comprises a motor driven rubber wheel or tire 38 that is supported on a vertical shaft for rotation by the motor M. The sorting station also includes an enclosure 42 that is kept at a low pressure by vacuum line 43. The low pressure in enclosure 42 provides for positive entry of the balls into the inlet A. Each ball in turn is drawn into the inlet A of the ball sorting device 34 and the wheel periphery rotates the balls around a horizontally disposed arcuate track defined in part by the periphery of the wheel or tire 38. This track is further defined by a frictional surface 40 provided around approximately one half the circumference or periphery of the wheel 38. The surface 40 is spaced from the periphery of the wheel 38 for this purpose, see FIG. 4. The frictional surface 40 may be in the form of a brush, and the periphery of the wheel is preferably elastomeric. The wheel periphery and the surface of the brush may be shaped so as to accommodate the spherical configuration of the balls being sorted. However as shown, the surface 40 need not be contoured and is flat. The wheel preferably has a conventional rubber tire tread thereon. When a ball moves into the inlet A of the ball sorting device 34 it will be moved around this track if the ball is generally spherical or round. If not round the ball will drop downwardly out of the space provided between the periphery of the wheel 38 and the surface 40 into the enclosure 42. The culled balls in the enclosure can be conveniently shunted into any convenient receptacle for disposal. A trap door in the enclosure (not shown) may be provided for this purpose.

Figure 5:
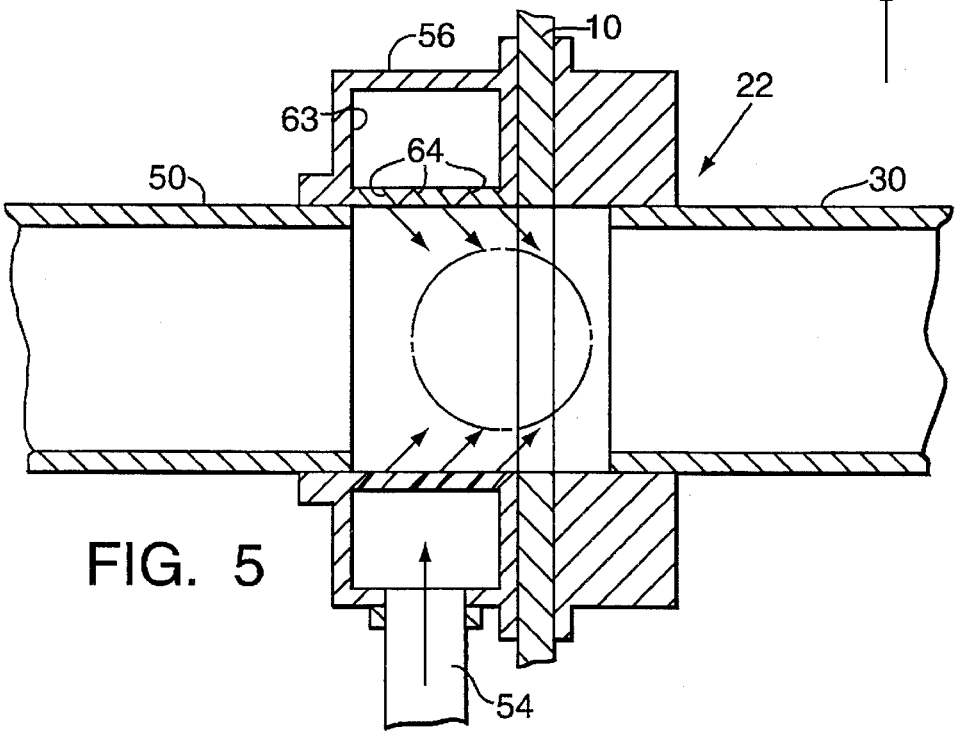
FIG. 5 is a sectional view through the downstream end of the ball washer conduit 50 showing the air flow through the nozzles at the end of this conduit.

Still with reference to FIG. 1, the sorting device 34 defines a ball outlet B through which the round balls move by action of the wheel 38. The balls then move into a gravity chute or conduit 44. The non-round balls will have been culled from the stream of balls at the sorting station 34 and only the round balls move through the conduit 44 into the ball washing station 36. The ball washing station may be similar to prior art U.S. Pat. No. 4,181,996 which is incorporated by reference herein. More particularly, the ball washing station 36 comprises a tank 46 in which a liquid is provided, the liquid being non-hazardous, but nevertheless adapted to disinfect the balls such that they can be returned to the recreational trampoline pit. The preferred liquid currently recommended for use in apparatus of the invention is ISOSEPT, made by Rexford Rand Corp., Michigan City, Ind. The washing station comprises a motor M2 adapted to drive a cylindrically shaped brush 48 in the tank 46 so as to move each ball in turn around a helical path defined by the tank 46 and by the tank cover 46A to the end that the balls exit from the washer. The washed balls are conveyed through exit conduit 50 by providing a negative pressure at the downstream end of conduit 50 as shown in FIG. 5. The air pump or blower 52 not only provides for a low pressure air inlet pressure at the entry A of the ball sorter, but also provides high pressure air in line 54 to create a venturi effect at the exit end of conduit 50. An annular chamber 63 is defined by ring 56 so that the nozzles 64,64 move the balls out of the enclosure 10 through exit port 22 into conduit 30. A funnel shaped flow of air into the exit end of conduit 50 moves the balls through the exit opening 22 and through conduit 30, preferably to a storage bag as suggested above.

The balls are of hollow lightweight plastic in keeping with the requirements of soft structure play units generally. The balls may range in size from 76–82 mm. The conduits 28 and 30 are necessarily larger in diameter, and preferably have a corrugated shape of approximately 110–125 mm in diameter.

We claim:

1. A ball washing and sorting system comprising in combination:

a ball sorting station, a ball washing station, pneumatic means including a pickup conduit having a ball pickup end for sucking balls into said pickup end for transporting balls into said sorting station, said sorting station including an inlet for receiving the balls, a reject device for culling balls that are deformed from a desired spherical shape, and an outlet for the balls not culled, means for transporting balls from said sorting station outlet to said ball washing station, said ball washing station having an inlet for receiving balls, a rotary brush, and means defining a path for the balls whereby the rotating brush moves the balls along a path from said washer inlet to a washer outlet.

2. The system according to claim 1 wherein said means for transporting balls from one said washer outlet to said ball storage station comprises pneumatic means including an air blower, a conduit for the balls, and a pressure line from the blower to said conduit.

3. The system according to claim 1, wherein said means for transporting balls from said ball washer outlet to said ball storage means further includes an air pressure line communicating with said exit conduit by angled nozzles to create a venturi action for moving the balls toward said ball storage station.

4. The system according to claim 1 wherein said reject device at said sorting station comprises means defining one and another generally parallel ball engaging surfaces, said one surface being spaced from said another surface by approximately the desired diameter of the balls to be sorted, said one surface being movable relative to said another surface to cause round balls to rotate along said other surface whereby out of round balls drop from between said spaced surfaces and are thereby culled.

5. The system according to claim 4 wherein said one surface comprises the periphery of a wheel mounted for rotation on a generally vertical axis such that the wheel periphery is spaced from said other surface by approximately said ball desired diameter, said other surface comprising a frictional surface engaging the balls whereby the round balls rotate along said other surface, and whereby non-round balls drop downwardly away from said spaced surfaces.

6. The system according to claim 5 wherein said other surface has a peripheral extent which is less than that of said wheel and which defines at least in part said inlet and outlet of said ball sorting station.

7. The system according to claim 6 wherein said means for transporting balls from said sorting station outlet to said ball washing station inlet comprises a gravity chute, said ball washing station including a fixed tank defining the lower portion of the path of the balls and adapted to contain a liquid for cleaning the balls, a top portion of said tank defining the upper portion of the path of the balls.

8. The system according to claim 1 further characterized by a wand for supporting the free end of said pick-up conduit, said conduit being flexible and said wand including handle portions for convenient manipulation of said free end thereof.

9. The system according to claim 8 wherein said pneumatic means includes an air blower, and a low pressure air line from said blower to said sorting station whereby said balls are sucked into said sorting station through said pick-up conduits.

10. The combination according to claim 9 wherein said means of transporting balls from said ball washer outlet to said bah storage means comprises pneumatic means including said air blower, an exit conduit for the balls, and an air pressure line from said blower to said exit conduit and communicating with said exit conduit by angled nozzles to create a venturi action for moving the balls toward said ball storage station.

11. The combination according to claim 10 wherein said reject device at said storing station comprises means defining one and another generally parallel ball engaging surfaces, said one surface being spaced from said another by approximately the diameter of the balls to be sorted, said one surface being movable relative to said another surface to cause round balls to rotate along said other surface whereby out of round balls drop from between said spaced surfaces and are thereby culled.

12. The combination according to claim 11 wherein said one surface comprises the periphery of a rotating wheel mounted on a generally vertical axis such that the wheel periphery is spaced from said other surface by approximately said ball diameter, said other surface comprising a frictional surface engaging the balls whereby the round balls rotate along said other surface, and whereby non-round balls drop downwardly away from said spaced surfaces.

13. The combination according to claim 12 wherein said other surface at said sorting station has a peripheral extent which is less than that of said wheel and which defines at least in part said inlet and outlet of said ball sorting station.

14. The combination according to claim 13 wherein said means for transporting balls from said sorting station outlet to said ball washing station inlet comprises a gravity chute, said ball washing station including a fixed tank defining the lower portion of the path of the balls and adapted to contain a liquid for cleaning the balls, a top portion of said tank defining the upper portion of the path of the balls.

15. A ball washing and sorting system comprising in combination a ball sorting station, a ball washing station, and means for transporting balls into said sorting station including pneumatic means having a pickup conduit with a ball pickup end for sucking balls into said pick up conduit, said sorting station including means for culling balls that are deformed from a spherical shape, means for transporting balls from said sorting station to said ball washing station, and said ball washing station having an inlet for receiving balls, a rotary brush and means defining a path for the balls whereby the rotating brush moves the balls along a path from said washer inlet to a washer outlet.

16. The system according to claim 15, wherein said means for transporting balls from said washer outlet to said ball storage station comprises pneumatic means including an air blower, a conduit for the balls, and a pressure line from the blower to said conduit.

17. The system according to claim 15, wherein said reject device at said sorting station comprises means defining one and another generally parallel ball engaging surfaces, said one surface being spaced from said another surface by approximately the desired diameter of the balls to be sorted, said one surface being movable relative to said another surface to cause round balls to rotate along said other surface whereby out of round balls do not reach said outlet for the balls not culled.

* * * * *

UNITED STATES PATENT AND TRADEMARK OFFICE

CERTIFICATE OF CORRECTION

PATENT NO. : 5,647,089
DATED : July 15, 1997
INVENTOR(S) : J. Richard Hollrock

It is certified that error appears in the above-indentified patent and that said Letters Patent is hereby corrected as shown below:

Column 4

Claim 10, Line 59, delete "bah" and substitute --ball--.

Signed and Sealed this

Thirtieth Day of September, 1997

*Attest:*

Bruce Lehman

BRUCE LEHMAN

*Attesting Officer*

*Commissioner of Patents and Trademarks*